US005115743A

United States Patent [19]

Löffler

[11] Patent Number: 5,115,743

[45] Date of Patent: May 26, 1992

[54] PROPELLANT CASING ASSEMBLY FOR AN ELECTROTHERMIC PROJECTILE FIRING DEVICE

[75] Inventor: Markus Löffler, Unterlüss, Fed. Rep. of Germany

[73] Assignee: TZN Forschungs- und Entwicklungszentrum Unterlüss GmbH, Unterlüss, Fed. Rep. of Germany

[21] Appl. No.: 537,046

[22] Filed: Jun. 12, 1990

Related U.S. Application Data

[63] Continuation of Ser. No. 351,120, May 12, 1989, abandoned.

[30] Foreign Application Priority Data

May 13, 1988 [DE] Fed. Rep. of Germany ..... 3816300

[51] Int. Cl.[5] ..... F42C 19/12

[52] U.S. Cl. ..... 102/472; 102/202.7

[58] Field of Search ..... 102/430, 440, 466, 468, 102/472, 202.5, 202.7, 202

[56] References Cited

U.S. PATENT DOCUMENTS

| | | | |
|---|---|---|---|
| H61 | 5/1986 | Yuhash et al. | 102/430 |
| 667,435 | 2/1901 | Friese-Greene et al. | 102/375 |
| 2,926,566 | 3/1960 | Atkins et al. | 102/472 |
| 2,975,332 | 3/1961 | Starr . | |
| 3,157,120 | 11/1964 | Morgan et al. | 102/202.5 |
| 3,228,333 | 1/1966 | Phelps et al. | 102/472 |
| 4,041,868 | 8/1977 | Rayle et al. | 102/468 |
| 4,711,154 | 12/1987 | Chryssomallis | 102/440 |

FOREIGN PATENT DOCUMENTS

| | | |
|---|---|---|
| 232594 | 8/1987 | European Pat. Off. . |
| 242500 | 10/1987 | European Pat. Off. . |
| 242501 | 2/1989 | European Pat. Off. . |
| 013360 | 12/1965 | United Kingdom . |
| 2123934 | 2/1984 | United Kingdom . |

OTHER PUBLICATIONS

"A Survey of Exploding Wire Progress" by W. G. Chace Exploding Wires vol. 3, Plenum Press, 1964, pp. 1-7.

"Exploding Wires" by Irwin Stambler, Space/Aeronautics Sep. 1960, pp. 48-51.

*Primary Examiner*—Stephen Johnson

*Attorney, Agent, or Firm*—Spencer & Frank

[57] ABSTRACT

A propellant casing assembly for an electrothermic projectile firing device has a casing and an electrically energizable coil disposed in the casing. The coil vaporizes at a predetermined current intensity and generates at least one part of propellant gases for accelerating a projectile.

5 Claims, 2 Drawing Sheets

PROPELLANT CASING ASSEMBLY FOR AN ELECTROTHERMIC PROJECTILE FIRING DEVICE

This application is a continuation of application Ser. No. 07/351,120, filed May 12, 1989 now abandoned.

BACKGROUND OF THE INVENTION

This invention relates to a propellant casing assembly for an electrothermic firing device for the acceleration of projectiles.

As disclosed, for example, in German Offenlegungsschrift (non-examined published application) U.S. Pat. No. 3,613,259, known firing devices whose operation is based on the electrothermic principle utilize the conversion of electromagnetic energy into thermal energy. It is a disadvantage of known electrothermic firing devices that the inductive storage elements for the energization are situated externally of the firing device and thus have an additional spatial requirement. It is a further disadvantage that for the charging of the inductive storage elements current intensities up to several hundreds of kiloamperes are needed which can be generated only by special energy sources such as homopolar generators or large condenser batteries. It is a further drawback that during the slow charging process of the storage elements, a substantial amount of energy is dissipated due to ohmic resistances.

SUMMARY OF THE INVENTION

It is an object of the invention to provide an improved casing assembly of the above-outlined type in which inductive storage elements can be disposed in a place-saving manner and which ensures that during charging of the storage elements energy losses are significantly reduced.

This object and others to become apparent as the specification progresses, are accomplished by the invention, according to which, briefly stated, in the casing a coil is disposed which, at a given current intensity vaporizes and thus constitutes entirely, or in part, the gas that propels the projectile.

Thus, according to the invention, the inductive storage element is situated within the casing proper. Upon completion of the supply of electromagnetic energy, the coil vaporizes and thus produces at least one part of the propellant gas which accelerates the projectile and further, the magnetic energy stored in the coil volume may be utilized for additionally heating the gas.

DESCRIPTION OF THE PREFERRED EMBODIMENT

Figure 1:
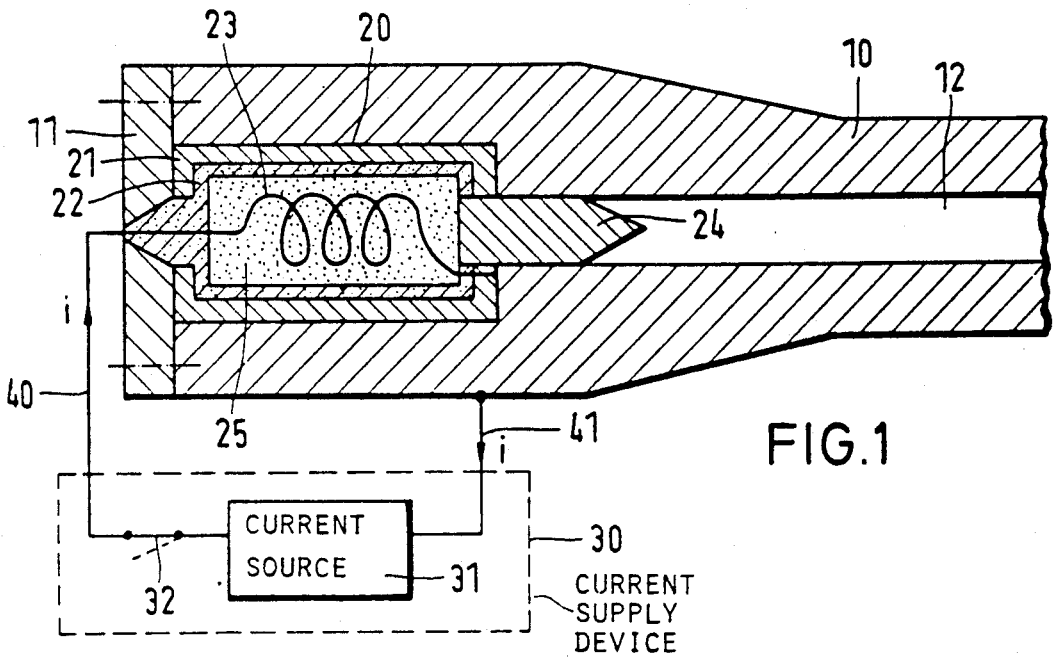
FIGS. 1, 2 and 3 are axial sectional views of the breech part of a gun incorporating a preferred embodiment of the invention, illustrating three different operational phases.

Turning to FIG. 1, there is illustrated therein the breech portion 10 of a gun barrel accommodating a propellant casing assembly 20 and the projectile 24. Current supply to the casing assembly is effected by a current supply device 30. The gun is closed with an end plate 11 and has a barrel bore 12.

Figure 4:
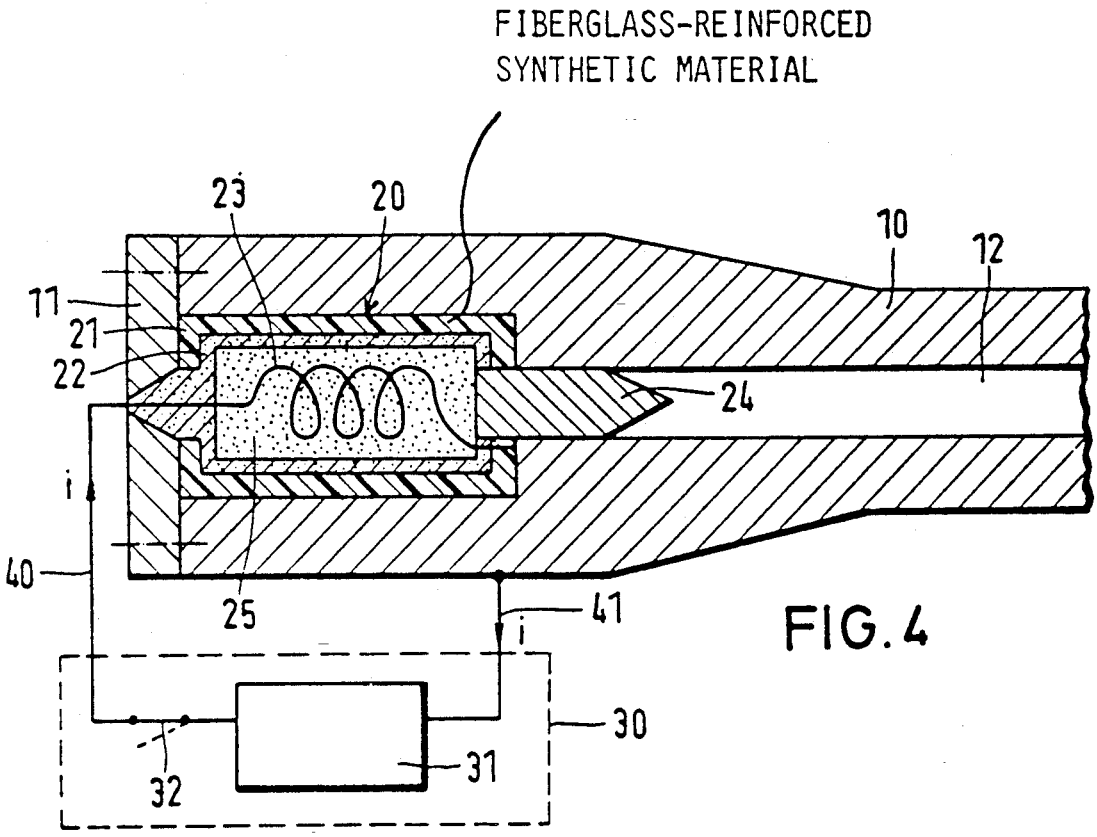
FIG. 4 is a view similar to FIG. 1, illustrating one of the compounds as being of a different material.

The casing assembly 20 comprises a container or casing proper 21 made of steel, fiberglass-reinforced synthetic material (as shown in FIG. 4) or other high-strength substance, an insulating jacket 22 and a coil 23. The latter is formed of an insulated conductor made, for example, of aluminum, lithium or graphite. The remaining volume of the casing assembly 20 is filled with an appropriate propellant 25. Such propellant is of a low molecular weight material such as methanol, lithium hydride, lithium, methane, water or coal dust. The casing assembly 20, together with the projectile 24 attached thereto is inserted into the barrel 10 and is mechanically immobilized by the rear closure plate 11.

The current supply device 30 which is essentially formed of the current source 31 proper and a switch 32, is electrically directly connected by a conductor 40 with one end of the coil 23. The circuit is completed by a conductor 41 which connects the other end of the coil 23 to the current source 31 via the casing 21 and the barrel 10.

Figure 2:
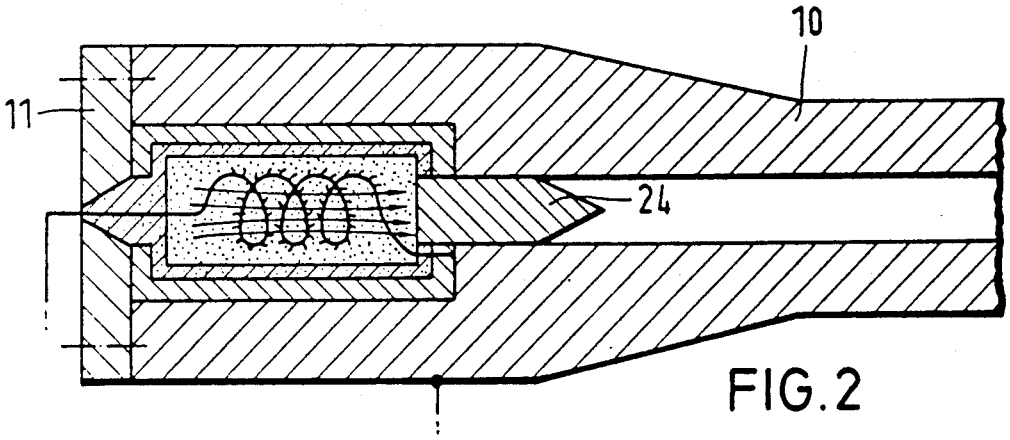

The inductivity of the coil 23 and thus its geometrical dimensions and number of turns are so designed that it can be charged to the desired magnetic energy by means of the maximum producible current from the primary energy source 31. The diameter of the coil turns is selected such that the turns vaporize as the maximum current intensity is reached as illustrated in FIG. 2. Thereupon, for maintaining the magnetic flux, the sum current of all coil turns continue to flow through the plasma thus generated. The magnetic energy which has been stored within the volume of the vaporizing coil is, in the ohmic resistance of the plasma converted to heat whereby the propellant material 25 (if present) is heated and converted into plasma. By virtue of the thermal pressure of the propellant gases generated in this manner, the projectile 24 is accelerated.

Figure 3:
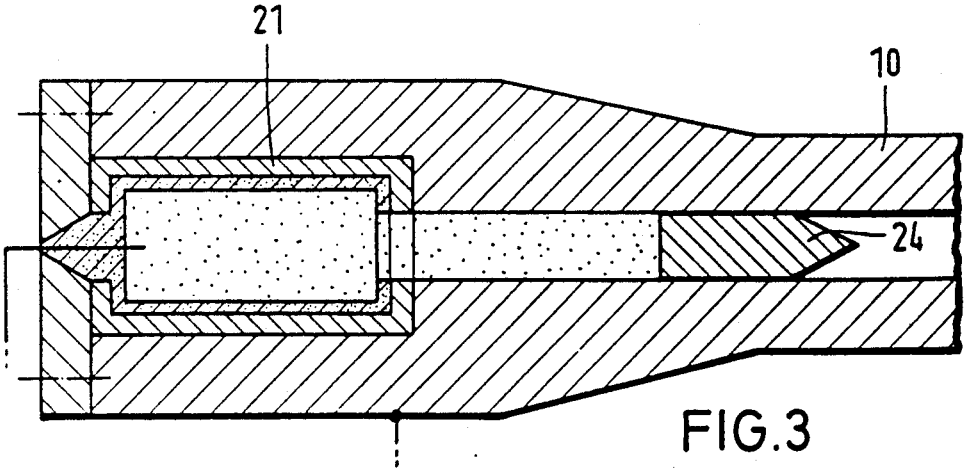

FIG. 3 depicts the barrel at a moment when the projectile 24 has been expelled from the casing assembly 21 but is still situated within the gun barrel 10 and the coil 23 has already evaporated. The container 21 and the insulating jacket 22 remain in the breech and must be removed before insertion of a new ammunition.

It will be understood that the above description of the present invention is susceptible to various modifications, changes and adaptations, and the same are intended to be comprehended within the meaning and range of equivalents of the appended claims.

What is claimed is:

1. An electrothermic device for firing a projectile, comprising (a) a replaceable, fiberglass-reinforced plastic casing operatively connectable with the projectile;

(b) an energy source for generating a plasma in said casing; said energy source including (1) a current source and (2) an inductive coil disposed in said casing and electrically connected to said current source to form a closable electric circuit therewith, whereby upon closing said electric circuit, current flow through said inductive coil generates a magnetic field therein and causes said inductive coil to vaporize and form a plasma in said casing for accelerating the projectile; an intensity of current obtainable from said current source and a geometry of said coil being coordinated such that energy associated with the magnetic field is of sufficient magnitude so that energy in form of heat into which the energy associated with the magnetic field is converted by an ohmic resistance of the plasma when the coil is partially vaporized, is sufficiently high to heat the plasma;

(c) an electrically insulating inner coating in said casing; and (d) a propellant accommodated in said casing.

2. An electrothermic device as defined in claim 1, wherein said inductive coil is an insulated conductor whose material is selected from the group consisting of aluminum, lithium and graphite.

3. An electrothermic device as defined in claim 1, wherein said propellant is of a plasma-forming material.

4. An electrothermic device as defined in claim 3, wherein said plasma-forming material is selected from the group consisting of methanol, lithium hydride, lithium, methane, water and coal dust.

5. An electrothermic device for firing a projectile, comprising (a) a replaceable, fiberglass-reinforced plastic casing operatively connectable with the projectile; and (b) an energy source for generating a plasma in said casing; said energy source including (1) a current source and (2) an inductive coil disposed in said casing and electrically connected to said current source to form a closable electric circuit therewith, whereby upon closing said electric circuit, current flow through said inductive coil generates a magnetic field therein and causes said inductive coil to vaporize and form a plasma in said casing for accelerating the projectile.

* * * * *

UNITED STATES PATENT AND TRADEMARK OFFICE

CERTIFICATE OF CORRECTION

PATENT NO. : 5, 115,743

DATED : May 26, 1992

INVENTOR(S) : Markus Löffler

It is certified that error appears in the above-identified patent and that said Letters Patent is hereby corrected as shown below:

On title page, item [21], "537,046" should read --537,006--

Signed and Sealed this

Twenty-fourth Day of August, 1993

*Attest:*

*Attesting Officer*

BRUCE LEHMAN

*Commissioner of Patents and Trademarks*